US006144018A

United States Patent [19]

Heizer

[11] Patent Number: 6,144,018

[45] Date of Patent: Nov. 7, 2000

[54] HEATING CABLE

[76] Inventor: Glenwood Franklin Heizer, 779 Dawson Avenue, London, Ontario, Canada, N6K 1B1

[21] Appl. No.: 08/858,060

[22] Filed: May 16, 1997

Related U.S. Application Data

[63] Continuation-in-part of application No. 08/657,522, Jun. 3, 1996, abandoned, which is a continuation-in-part of application No. 08/469,493, Jun. 6, 1995, abandoned, which is a continuation-in-part of application No. 08/116,367, Sep. 3, 1993, abandoned.

[30] Foreign Application Priority Data

Feb. 8, 1993 [CA] Canada ..... 2089048

[51] Int. Cl.[7] ..... H05B 3/54

[52] U.S. Cl. ..... 219/529; 219/505; 219/553

[58] Field of Search ..... 219/529, 505, 219/553; 338/22 R, 333, 23 R; 420/457, 458, 442, 441, 459

[56] References Cited

U.S. PATENT DOCUMENTS

| | | | |
|---|---|---|---|
| 2,422,477 | 6/1947 | Driver . | |
| 2,947,963 | 8/1960 | Oakley . | |
| 3,492,622 | 1/1970 | Hayashi . | |
| 3,538,482 | 11/1970 | Dugger . | |
| 3,757,086 | 9/1973 | Indoe . | |
| 4,037,083 | 7/1977 | Leavines . | |
| 4,103,276 | 7/1978 | Kennon . | |
| 4,523,086 | 6/1985 | Eilentropp . | |
| 4,864,107 | 9/1989 | Boyal | 219/549 |
| 5,245,161 | 9/1993 | Okamoto . | |

FOREIGN PATENT DOCUMENTS

| | | |
|---|---|---|
| 2110910 | 6/1983 | United Kingdom . |

*Primary Examiner*—Teresa Walberg
*Assistant Examiner*—Vinod D Patel
*Attorney, Agent, or Firm*—Baker & Daniels

[57] ABSTRACT

A heating cable for maintaining pipes and related equipment at temperatures above freezing or at elevated process temperatures. The heating cable includes a pair of elongated electrode wires each coated with a layer of insulating material. The layer of insulating material is partially stripped off the wires at spaced, alternating locations. A resistive heater wire is helically wound around a yarn of fibrous insulating material to form an elongated resistor core. The elongated resistor core is spirally wound around the electrode wires and is brought into electrical contact with the electrode wires at the alternating locations where the wires are partially stripped. A second layer of insulating material covers the elongated resistor core and forms an outer surface for the cable.

11 Claims, 4 Drawing Sheets

HEATING CABLE

This application is a Continuation-in-part of, and claims the benefit under Title 35, U.S.C. §§ 119 and 120 of application Ser. No. 08/657,522, filed Jun. 3, 1996, now abandoned; which is a Continuation-in-part of application Ser. No. 08/469,493, filed Jun. 6, 1995, now abandoned; which is a Continuation-in-part of application Ser. No. 08/116,367, filed Sep. 3, 1993, now abandoned; which corresponds to Canadian patent No. 2,089,048, filed on Feb. 8, 1993.

BACKGROUND OF THE INVENTION

1. Field of the Invention

The present invention relates to the field of electrical heating cable typically used to maintain pipes and related equipment at temperatures above freezing or at elevated process temperatures. In particular, the present invention provides an improved parallel zone heating cable with enhanced flexibility and shortened zone lengths.

2. Description of the Prior Art

Parallel zone heating cables are known per se and are in common usage in refineries, chemical plants, commercial and residential installations, and identified as heat tracing cables. In a typical construction of a parallel zone cable, two or three insulated bus wires (also called electrode wires) are provided. They may be solid or stranded, and are typically insulated with polyvinyl chloride, thermoplastic elastomers, fluoropolymers, or any other known and temperature rated conventional insulation. The insulated bus wires are jacketed with a further layer of insulating material, which is provided to maintain the bus wires in a parallel, untwisted configuration, as is necessary for further processing. The insulation over the bus wire insulation is skived in 1 or 2 inch sections, at alternating sites from bus wire to the other, along the full length of the cable, to expose the metal bus wire. A heater wire of known resistance, measured in ohms/lineal foot, is then spirally wrapped around the jacketed bus wires, making electric contact at the alternating exposed sites, with the bus wire. A layer of Fibreglass may then be wound over the heater wire, to secure and cushion the heater wire, and the entire construction is then jacketed with an electrically insulated layer.

The cable described above has been in common use for a number of years and in most conditions will function quite well. However, the heater wire that has traditionally been utilized has been a monofilament wire, and under conditions of rough handling or high temperature cycling tends to break, causing a heater zone (being the distance between two adjacent sites where the insulation has been skived away) to be interrupted, and thereby lose its heating ability. A small number of random zone failures is not considered fatal to a cable, since a zone will be heated by the preceding and following functioning zones, such as on a pipe containing water, oils or chemicals. However, a number of successive zone failures will prevent reasonable operation of the heater cable and will necessitate its removal and replacement.

It has also been observed in parallel zone cables of the sort described above, that thermal shock to the heating wire during the application of an extruded outer jacket may cause the heater wire to form a v-shaped groove along the inner curve of a cable between the bus wires. This is referred to as chevroning and may, in a high temperature thermal cycling environment, result in heat wire kinking and breakage.

SUMMARY OF THE INVENTION

The object of the present invention, in view of the foregoing, is to provide a parallel zone electrical heating cable that is very flexible and is able to withstand rough handling and high temperature cycling with a minimum, if any, zone failure. A further objective of the present invention is to provide such heating cable with much shorter zone lengths. It is desirable to have short zone lengths as this will minimize the impact of zone failure and non-heating zones when the cable construction is interrupted between skive points.

The objects of the present invention are substantially met, and the defects of the prior art overcome, by utilizing a different form of heating element, one that is less susceptible to kinking or breaking and capable of withstanding high temperature thermal shock environments. To this end, the applicant has designed a heating element in the form of an elongated resistor core, a length of Fibreglass or other temperature rated insulating yarn, having good flexibilities provided, and a small diameter resistive wire is helically wound around the same. The resulting elongated resistor core will exhibit a much higher resistance measured in ohms/lineal foot since it utilizes a much greater length of heater wire per length of the Fibreglass, or temperature equivalent, yarn, than the final length of the resistor core. Moreover, the elongated and helically wound resistor core, even though tightly wrapped, will exhibit much more pronounced flexibility than a monofilament heating wire. This flexibility serves to eliminate breakage due to mechanical impact, rough handling and/or chevroning.

Furthermore, the innovative design of the elongated resistor core permits it to be rapidly cycled at higher temperatures without damage than experienced with monofilament designs. In conventional design, the heater wire contraction and expansion is substantially linear and uncushioned, resulting in breakage of the heater wire. Additionally, conventional monofilament wire is often loosely applied to conventional zone cable constructions which results in poor electrical contact with the electrode bus wires.

The helically wound composite core herein described is much more rugged, has a higher tensile strength and may be wound tightly over the insulated electrode bus wires.

Resistor cores comprising elongated filaments wrapped with fine resistive wires have heretofore been utilized, in electrical circuitry, as a means of increasing effective overall resistance for resistance bodies of necessarily short length, such as those found in automobile ignition circuits. For instance, in U.S. Pat. No. 3,492,622, Hayashi et al disclose a so-called double wound wire, in which a resistor core formed by spirally winding a fine resistive wire around an insulating core, and then spirally winding the resistor core around a second insulating core, will further increase the overall resistance. However, resistor cores have not been utilized heating applications and in particular, they have not been utilized in zone type heating cables of the sort described above, because the provision of sufficient and effective resistance has always been possible utilizing ordinary or positive temperature coefficient of resistance (PTC) heater wire. Moreover, the benefits of increased ruggedness and flexibility resulting from the use of elongated resistor cores has not been obvious, since an elongated resistor core utilizes a finer heater wire than a heater wire not wound around an insulating core, and the conventional wisdom was that a thicker wire was a stronger wire, better able to withstand rough handling and rapid thermal cycling. Therefore, cable manufacturers have been discourage from the use of elongated resistor cores.

The present applicant has discovered, however, that utilizing only insulating yarns, as cores, a significant cushioning effect is achieved, permitting the use of fine resistive wires to obtain improved, rather than less effective, protection against impact or thermal cycling.

In order to assure constant electrical contact between the elongated heater core and the electrode wires at the stripped portions of same, and to provide additional impact cushioning, a fibreglass (or other insulating yarn) layer is braided or spirally wound over the resistor core after it is wound around the electrode wires. A final insulating layer is then applied.

In a broad aspect, the present invention relates to a heating cable, including: (a) a pair of elongated electrode wires, each of said wires being coated with a first layer of insulating material, said first layer of insulating material being at least partially stripped off selected ones of said wires at spaced, alternating locations; (b) a resistive heater wire which together with a yarn of fibrous insulating material is spirally wound around said electrode wires whereby said heater wire is brought into electrical contact with said selected ones of said electrode wires at said alternating locations, to electrically connect said alternating locations with said resistive heater wire; (c) a second layer of an insulating material over said resistive heater wire and insulating material forming an outer surface for said cable.

BRIEF DESCRIPTION OF THE DRAWINGS

In drawings that illustrate the present invention by way of example.

DESCRIPTION OF THE PREFERRED EMBODIMENT

Figure 1:
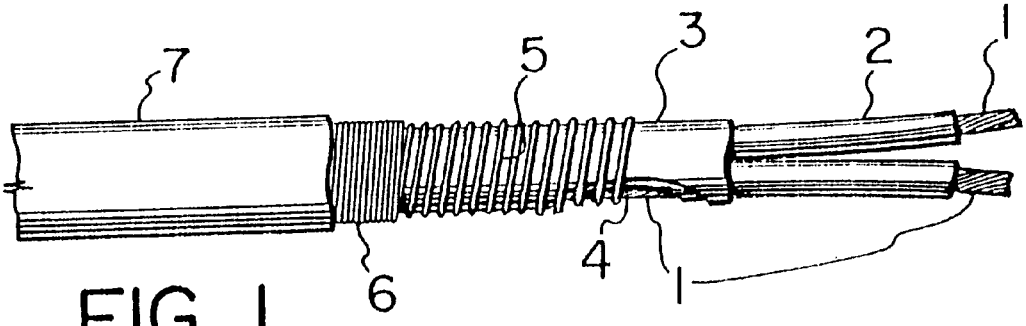
FIG. 1 PRIOR ART
FIG. 1 is a perspective view partially cut away of a parallel zone heating cable typical of the prior art.
Figure 2:
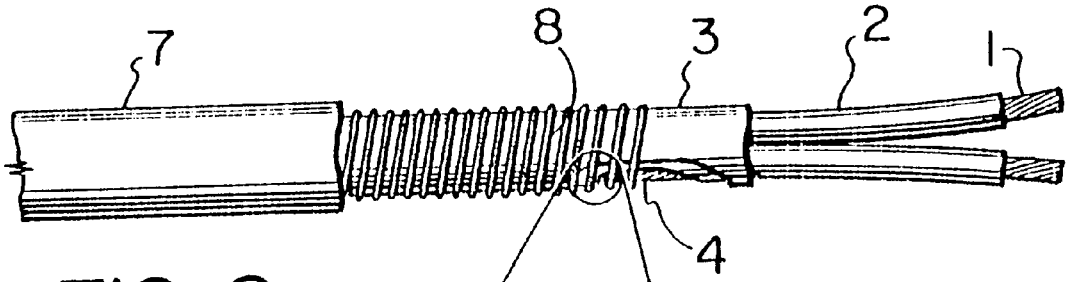
FIG. 2 is a perspective view partially cut away of a heating cable of a first embodiment of the present invention.
Figure 2A:
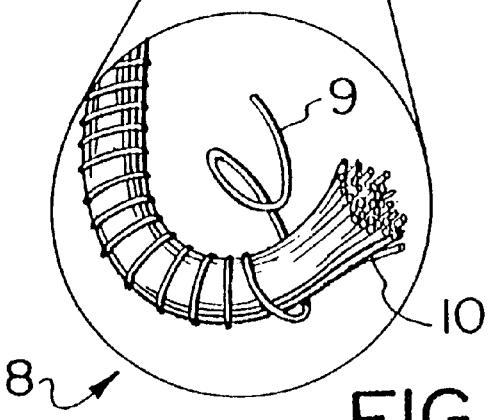
FIG. 2A is a detail view of the end of a heater wire construction of the cable of FIG. 2.
Figure 3:
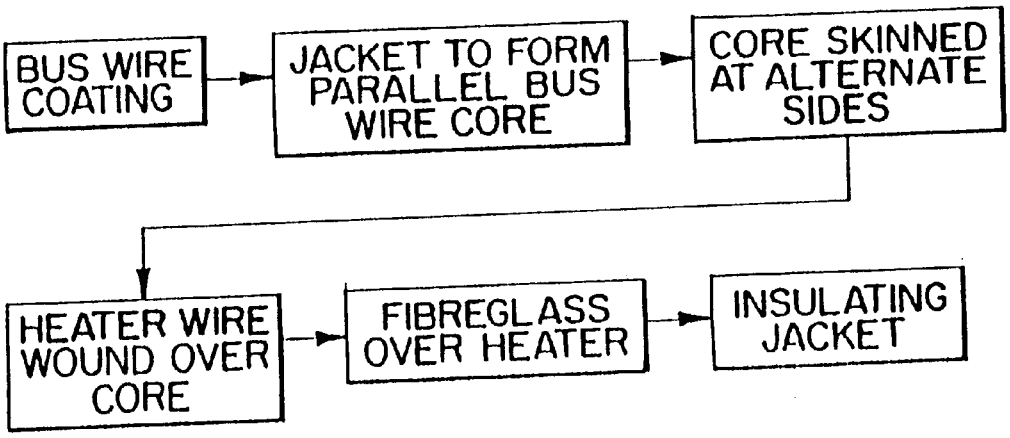
FIG. 3 PRIOR ART
FIG. 3 is a schematic of the manufacturing method for manufacturing the prior art cable of FIG. 1.
Figure 4:
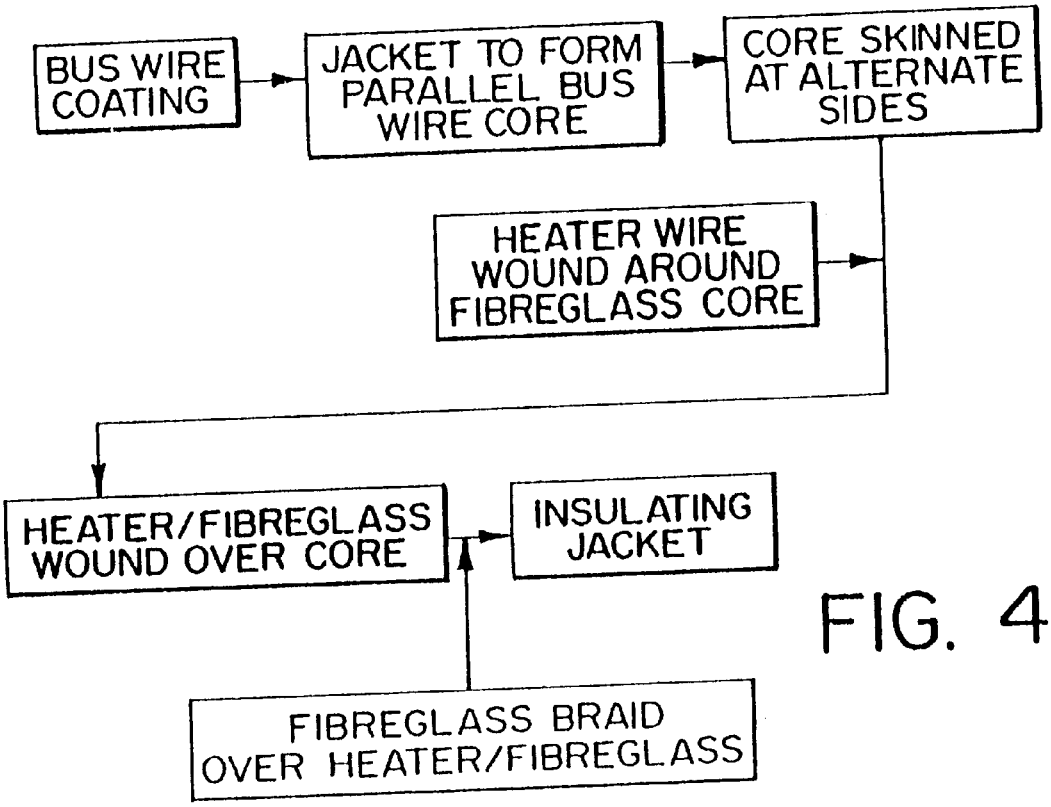
FIG. 4 is a schematic of the manufacturing method for manufacturing the cable of the present invention.

Referring now to FIGS. 1 and 3, it will be seen that prior art parallel zone heating cables provide a pair of bus wires 1, coated with insulation 2. The pair of insulated bus wires is then coated, while in a parallel state, with an insulator coat 3. At alternating locations 4, typically 12–36 inches apart, the insulating coats 2 and 3 are stripped off one bus wire, then the metal of the other bus wire, and so on. A heater wire 5 is then wound around the alternately stripped bus wires to make electrical contact with the bus wires 1, to create heating circuits between the bus wires, corresponding to the distance between stripped locations on the bus wires. A fibreglass layer 6, which may be a woven braid or helically applied yarn, may then served over the heater wire. A final layer of insulation 7 is then extruded over the fibreglass layer, yielding a finished product.

The present invention, on the other hand, as can be understood from FIGS. 2, 2A, 4, 5 and 6, provides a different construction to achieve an end result that shares many basic characteristics of known parallel zone heating cables, but is an improvement over same.

Figure 5:
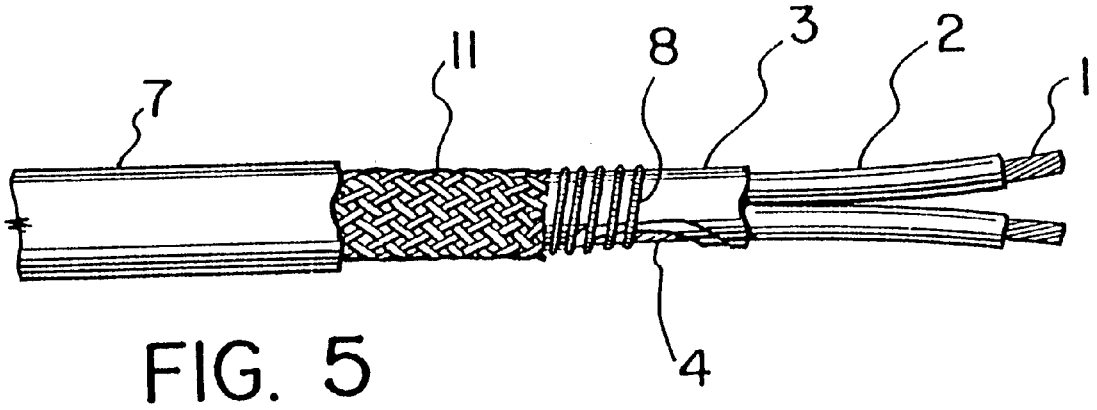
FIG. 5 is a side elevation, partially cut away, of a second embodiment of the invention.

According to the present invention, a similar pair (for a two phase power cable) of parallel, untwisted and insulated 2 bus wires 1 is coated with an insulating jacket 3, and stripped at alternating locations 4. A comparison of FIGS. 3 and 4, however, indicates that at this point, the present invention diverges from the prior art. Whereas in the FIG. 3 prior art method of manufacture a heater wire 5 (see FIG. 1) is then wound directly over the bus wire core, in the method of the present invention, a heater wire 9 (see FIG. 2A) is wound over a fibreglass or other fibrous insulating core 10, and then the heater wire/fibreglass elongated resistor core 9/10 is wound over the bus wires. Depending on the desired use of the product, a fibreglass layer 11 may be braided or wound over the heater wire/fibreglass combination, as shown in FIG. 5. Use of a fibreglass layer 11 provides an added measure of assurance of good electrical contact between the heater wire and the electrode wire.

It will be understood that the heater wire 9 utilized in the present invention may be very much finer than that of the prior art. This feature, combined with the cushioning effect of the fibreglass core 10 provides a heating element combination that is very flexible and supple.

Moreover, it has been observed that such a combination 9/10, because of the cushioning effect of fibreglass core 10, is capable of withstanding mechanical impacts associated with an individual installation environment and rapid heat and cooling cycles without breakage, unlike the heater wire of the prior art, that is wound directly onto the fairly unyielding bus wire core. Furthermore, because a greater length of heater wire 9 is utilized, helically wrapped around a fibreglass core 10, shorter zone lengths are possible, as a side benefit.

Figure 6:
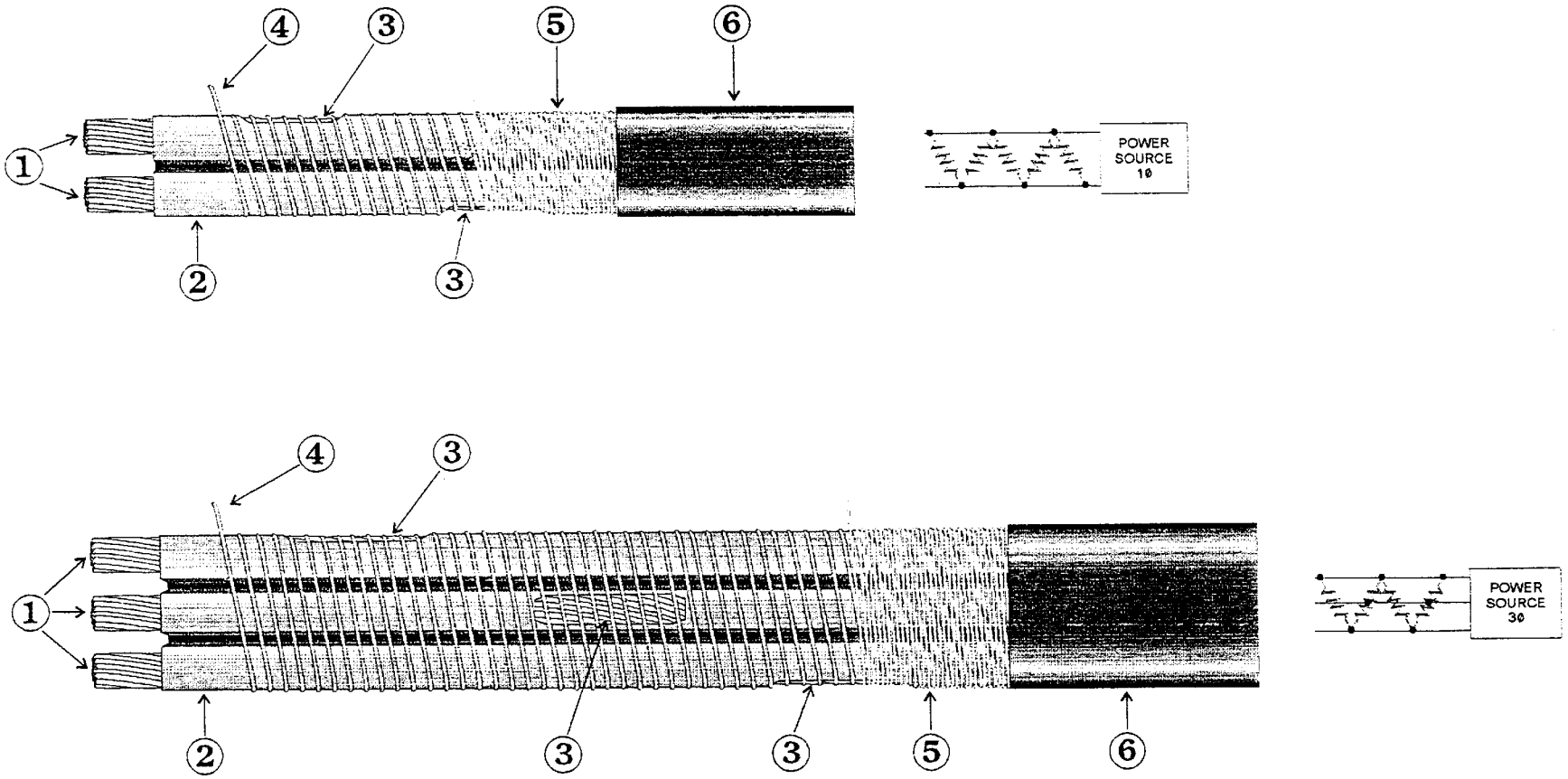
FIG. 6 is a side elevation, similar to FIG. 5, of the embodiment of the invention illustrated in FIG. 5, as applied to a three phase power heating cable.

The present invention may also be applied to three phase cables, as illustrated in FIG. 6.

In a typical cable, according to the present invention, the following materials are used:

bus wire 1: stranded copper, AWG 18-10
insulating material 2: PVC or similar
insulating material 3: PVC or similar
resistor core 10: fibreglass, stranded yarn
heater wire 9: 70% Ni, 30% Fe, AWG 30–48 (up to 99% Ni wires with similar PTC turn-down phenomena are suitable)
insulating jacket 7: PVC or similar
braid 11: fibreglass yarn This construction results in a cable having technical specifications that meet or exceed industry standards, with short zones and good impact resistance, as well as superior ability to withstand rapid heating cycling without breaking down.

Generally, the heater wire composition comprises at least 50% nickel and the remainder chromium, copper, iron or a combination thereof. As noted above, up to 99% nickel wire with similar PTC turn-down phenomena are suitable.

It will be understood that the foregoing table is by no means exhaustive. Bus wire 1 may be any desired, single or multi strand wire, as will be obvious to one skilled in the art. Insulating layers 2, 3, 7 may be FEP, PTFE, PFA, TPR, PVC, fibreglass, ceramic fibre, or any other suitable insulation.

Heater wire 9 may be AWG 30 to AWG 48, and insulating core 10, as well as being fibreglass, may be polypropylene, polyester, ceramic fibres, or other suitable temperature rated material. The selection of heater wire 9 will depend on the desired characteristics and the intended use of the cable.

Preferably, a heater wire exhibiting positive temperature coefficient of resistance (PTC) is used, and in this regard, a minimum 60% nickel wire is desirable. The balance may be chrome, copper, or iron, or a combination thereof. Preferably, 70% nickel to 99% nickel, remainder iron, alloy is utilized.

It has further been discovered that a conventional heater wire, without PTC characteristics may be advantageously utilized in the present invention. Whereas one might have expected a conventional wire, of fine diameter, to fail due to an inability to withstand repeated thermal cycling, the applicant has discovered that since a much greater length of heater wire is used in the present invention as opposed to the prior art, a much larger surface area of heater wire results. This permits a cable to produce a similar amount of heat, with a cooler surface temperature than conventional cables, resulting in less stress on the heater wire.

Advantageously, a construction utilizing conventional heater wire is spirally over-wound with fibreglass yarn, to maintain the spacing of the loops of the resistor core, and further cushion the resistor core, with its heater wire, against thermal or mechanical shock.

It is to be understood that the examples described above are not meant to limit the scope of the present invention. It is expected that numerous variants will be obvious to the person skilled in the heat tracing field art, without any departure from the spirit of the present invention. The appended claims, properly construed, form the only limitation upon the scope of the present invention.

What is claimed is:

1. A heating cable, including:

(a) at least a pair of elongated electrode wires, each of said wires being coated with a first layer of insulating material, said first layer of insulating material being at least partially stripped off selected ones of said wires at spaced, alternating locations;

(b) a resistive heater wire helically wound around a yarn of fibrous insulating material to form an elongated resistor core, said resistor core being spirally wound around said electrode wires whereby said heater wire is brought into electrical contact with said selected ones of said electrode wires at said alternating locations, to electrically connect said alternating locations with said resistive heater wire;

(c) a layer of fibrous insulating material disposed over said resistive heater wire, said layer of fibrous insulating material one of wound and braided;

(d) a second layer of an insulating material disposed over said resistive heater wire, said second layer of insulating material forming an outer surface for said cable.

2. A heating cable as described in claim 1, wherein said yarn of insulating material around which said heater wire is wound is selected from the group including fibreglass, polypropylene, polyester and ceramic fibre.

3. A heating cable as described in claim 2, wherein said heater wire is wire exhibiting positive temperature coefficient of resistance.

4. A heating cable as described in claim 3, wherein said heater wire is an alloy containing at least 60% nickel, and the remainder chromium, copper, iron, or a combination thereof.

5. A heating cable as described in claim 4, wherein said heater wire contains from 70% to 99% nickel, and the remainder including iron.

6. A heating cable as claimed in claim 2, wherein said heater wire is a conventional heater wire not exhibiting PTC characteristics.

7. A heating cable as claimed in claim 3, wherein said layer made of a yarn of fibrous insulating material is made from fibreglass, polyester or similar yarn, braided snugly over said layer of resistive heater wire together with a yarn of fibrous insulating material.

8. A heating cable as claimed in claim 7, further including a layer of fibrous material applied over said elongated resistor core.

9. A heating cable as claimed in claim 6, wherein said layer made of a yarn of fibrous insulating material is made from fibreglass, polyester or similar yarn, braided snugly over said layer of resistive heater wire together with a yarn of fibrous insulating material.

10. A heating cable as claimed in claim 9, further including a layer of fibrous material applied over said elongated resistor core.

11. A heating cable as claimed in claim 1, wherein said layer of fibrous insulating material is disposed between said resistive heater wire and said second layer of insulating material.

* * * * *